United States Patent [19]

Gamm

[11] Patent Number: 4,800,910

[45] Date of Patent: Jan. 31, 1989

[54] WALKER

[75] Inventor: Paul B. Gamm, Cincinnati, Ohio

[73] Assignee: The Kendall Company

[21] Appl. No.: 18,041

[22] Filed: Feb. 24, 1987

[51] Int. Cl.[4] ..... A61H 3/00

[52] U.S. Cl. ..... 135/67; 297/6

[58] Field of Search ..... 135/67, 68, 69, 72, 135/73, 84; 272/70.1, 70.2, 70.3, 70.4; 297/6; 16/44

[56] References Cited

U.S. PATENT DOCUMENTS

| | | | |
|---|---|---|---|
| 994,194 | 6/1911 | Pratt | 135/82 |
| 1,348,531 | 8/1920 | Amadio | 135/82 |
| 1,527,239 | 2/1925 | Vaughan et al. | 135/85 |
| 2,176,551 | 10/1939 | Solem | 16/44 |
| 2,377,649 | 6/1945 | Quinney | 297/68 |
| 2,445,942 | 7/1948 | Dusinberre | 135/85 |
| 2,472,686 | 6/1949 | Snyder | 16/44 |
| 2,590,052 | 3/1952 | Stuits | 135/85 |
| 2,613,389 | 10/1952 | Cramer | 16/44 |
| 2,745,465 | 4/1960 | Hogan | 297/6 |
| 2,792,874 | 5/1957 | Sundberg | 172/70.4 |
| 3,054,623 | 9/1962 | Wimpkins | 280/43.14 |
| 3,387,618 | 6/1968 | Swann | 135/67 |
| 3,743,051 | 7/1973 | Cramer | 182/15 |
| 3,826,336 | 7/1974 | Cramer | 182/15 |
| 4,109,926 | 8/1978 | Lane | 180/39 |
| 4,155,423 | 5/1979 | Miller | 182/33 |
| 4,166,516 | 9/1979 | Thurmond | 182/15 |
| 4,180,086 | 12/1979 | Thomas | 135/74 |
| 4,212,493 | 7/1980 | Ledesky | 197/6 |
| 4,251,105 | 2/1981 | Barker | 297/6 |
| 4,510,956 | 4/1985 | King | 135/67 |
| 4,510,957 | 4/1985 | Frank | 135/84 |
| 4,537,233 | 8/1985 | Vroonland et al. | 141/387 |

FOREIGN PATENT DOCUMENTS

| | | |
|---|---|---|
| 0007708 | 10/1978 | European Pat. Off. . |
| 2267750 | 11/1975 | France . |
| 1342397 | 1/1974 | United Kingdom . |
| 1096547 | 12/1976 | United Kingdom . |
| 2076666 | 12/1981 | United Kingdom . |

*Primary Examiner*—Robert A. Hafer
*Assistant Examiner*—Charles H. Sam
*Attorney, Agent, or Firm*—Wood, Herron & Evans

[57] ABSTRACT

A walker having a unique leg support system in which the walker's two stationary front legs are interchangeable at the user's discretion with two wheeled front legs, both types of legs being height adjustable relative to the walker's framework. The wheeled front legs are connectable to the walker's frame so the wheels can be oriented on either the outboard or the inboard of the walker's front leg. Each wheeled front leg includes a wheel axle and a pivot axle connected thereto, the pivot axle being pivotably connected to a front leg so the front leg can roll along a support surface, e.g., ground, on the wheel when the wheel is pivoted to a first position and so the front leg's foot can stand stationary on the support surface when the wheel is pivoted to a second position. The wheel is continuously spring loaded toward the first position where the wheel axle abuts the front leg's exterior surface so the walker's wheeled leg is biased into the first position when the walker is not in use, but can be pivoted to the second position in response to a user's downward force on the walker when it is in use.

11 Claims, 1 Drawing Sheet

WALKER

Figures 1, 1A, 2, 3:
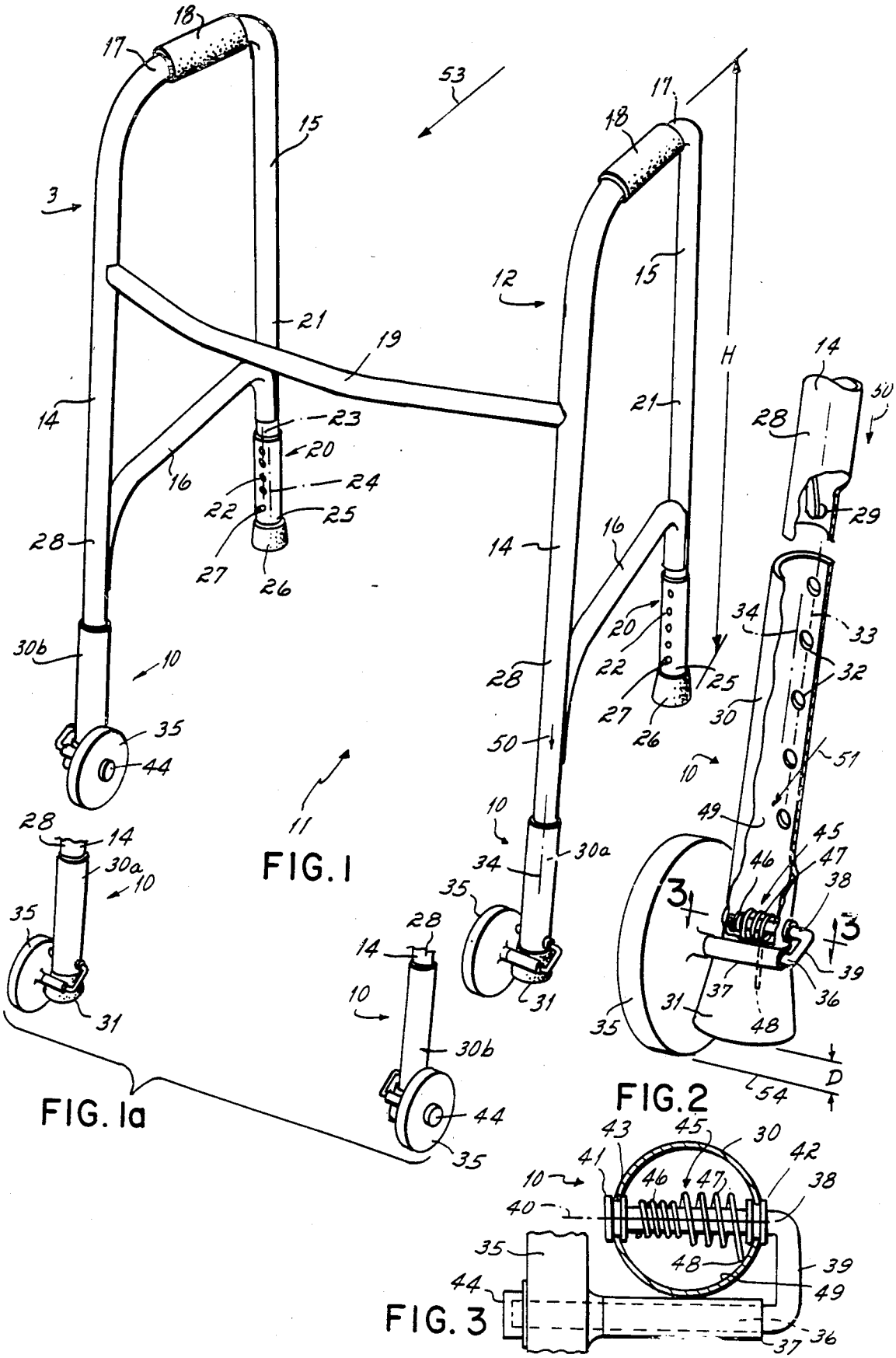

This invention relates to support leg systems. More particularly, this invention relates to a unique support leg system for patient aid devices such as, e.g., walkers.

Walkers are very well known to the prior art, and have been in use by patients, as well as the elderly, at hospitals, nursing homes, and at home for very many years. A walker basically consists of two side frames, each of which has a front leg and a rear leg, that are connected with one another by at least one front brace to complete the walker's framework. The walker's side frames each have a hand grip along a top edge so that a user can take a step into the framework while supporting himself with the hand grips, then lift the walker and move it forward, and thereafter take another step into the framework. This permits the user to walk slowly forward while supporting himself with his hands and arms, as well as his legs. The walker is most often used by elderly persons who have trouble walking alone. But the walker is often used by others such as patients with temporary leg problems or the like.

One of the problems encountered by the elderly in use of a walker is that of the walker's weight. The walker, as beforementioned, must be picked up by the user and moved forward before the user can take a successive step into the walker. Even when the walker is made of the lightest weight materials, sometimes the walker's weight to the user is so significant as to preclude a natural type use of the walker. And in other cases, the user may have badly damaged or infirmed hands, e.g., due to arthritis or the like, so that actual lifting of the walker through use of the walker's hand grips is quite difficult and/or awkward.

In an effort to alleviate this problem, the concept of a walker with a wheeled leg support system has been developed, and that concept is known to the prior art. In such prior art wheeled walkers, at least the walker's two front legs are provided with wheels. These wheels may be spring loaded or biased so that, when the walker is not in use, the feet of the walker's front legs are lifted slightly off ground. However, when the user grabs hold of the walker's hand grips to walk into the walker's framework, the downward force exerted by the user on the framework overcomes the spring bias so that the feet of the walker's front legs contact ground to maintain the walker's stability while the user is taking a step into the walker's framework. Subsequently, and when the user desires to move the walker forward so that another step can be taken, the user simply releases the downward force on the framework and the spring bias pushes the front legs' feet off the ground so that those front legs are again mobile due to the front legs' wheels. The user then simply pushes the walker forward on the wheels without raising it off the ground until the desired forward position is achieved. And the step forward use procedure is repeated over again thereafter.

But the prior art wheeled walkers have problems from an end use standpoint. In other words, the wheeled support leg systems used in prior art walkers have had a number of drawbacks from a structural and/or functional standpoint. Primarily, the prior art structures have lacked a combination of advantages or features which have been found to be desirable by a typical end user. Specifically, prior art wheeled walkers have lacked one or more of the following features, namely, height-adjustable wheeled legs, leg stability that is not as safe as what might be desired in light of the fact these walkers are often used by the elderly and infirmed, too much downward pressure required to remove the rolling feature of the walker's front legs, and undependability over a prolonged useful life.

Accordingly, it has been one objective of this invention to provide an improved support leg system for two support legs, and particularly an improved support leg system adapted for a patient aid device such as a walker, in which two main support legs each have stationary and mobile leg sections interconnectable therewith, those leg sections incorporating a connector that cooperates with the associated main support leg to permit the wheels of the mobile leg sections to be positioned either adjacent to each other inboard of the main support legs or separated one from the other outboard of the main support legs.

It has been another objective of this invention to provide an improved support leg system, and particularly an improved leg support system adapted for a patient aid device such as a walker, where the system includes a leg section detachably connectable to a main support leg, a pivot axle connected to the leg section, that pivot axle also being connected to a wheel axle, the wheel axle being positioned outboard of the leg section, and a wheel carried on a wheel axle, the pivot axle being continuously pivotable in response to a spring loading on an axis perpendicular to the leg section's axis toward a first position where the wheel axis abuts the leg's exterior surface and where the leg can roll along a support surface, and being pivotable in response to a downward force on that leg system against that spring loading on that same axis toward a second position at which the leg's foot can stand stationary on the support surface, thereby providing a simple wheeled leg support system that has a significant useful life with nominal maintenance problems.

In accord with these objectives, this invention is particularly directed to a walker having a unique leg support system in which the walker's two stationary front legs are interchangeable at the user's discretion with two wheeled front legs, both types of legs being height adjustable relative to the walker's framework. The wheeled front legs are connectable to the walker's frame so the wheels can be oriented on either the outboard or the inboard of the walker's front leg. Each wheeled front leg includes a wheel axle and a pivot axle connected thereto, the pivot axle being pivotably connected to a front leg so the front leg can roll along a support surface, e.g., ground, on the wheel when the wheel is pivoted to a first position and so the front leg's foot can stand stationary on the support surface when the wheel is pivoted to a second position. The wheel is continuously spring loaded toward the first position where the wheel axle abuts the front leg's exterior surface so the walker's wheeled leg is biased into the first position when the walker is not in use, but can be pivoted to the second position in response to a user's downward force on the walker when it is in use.

Other objectives and advantages of this invention will be more apparent from the following detailed description taken in conjunction with the drawings in which:

FIG. 1 is a front perspective view of a walker having a support leg system for the walker's front legs in accord with the principles of this invention;

FIG. 1*a* is a perspective view of the front legs of the walker shown in FIG. 1 but with the wheels mounted in an alternative position on the walker's front legs;

FIG. 2 is a partially cut-away perspective view of a mobile leg section attachable to the main support leg of the walker shown in FIG. 1; and FIG. 3 is a cross sectional view taken along line 3—3 of FIG. 2.

A support leg system 10 in accord with the principles of this invention, as incorporated in a wheeled walker 11, is illustrated in FIG. 1. The walker 11 basically includes two opposed parallel side frames 12. 13, each of which includes a front leg 14 and a rear leg 15. Each of the side frames 12, 13 includes a lower brace 16 fixed between the front 14 and rear 15 legs, and an upper brace 17 fixed to the front and rear legs, to maintain those legs in spatial and connected relation. The upper brace 17 of each side frame 12, 13 is provided with a hand grip 18 and it is the hand grips that are held by the walker's user during its use. The two side frames 12, 13 are connected by a front cross brace 19 to create the closed front/open back walker 10 structure.

Each of the walker's rear legs 15, as shown in FIG. 1, is provided with a stationary leg section 20 connectable to its main support leg 21. This stationary leg section 20, which is known to the prior art, is of a tubular cross sectional configuration, and is provided with a series of holes 22 located on a line 23 parallel to the tube's axis 24. The bottom end 25 of the tubular leg section 20 is provided with a cup shaped rubber foot 26. The tubular leg section 20 is slideable over, i.e. telescopable relative to, the main support leg 21. It is held in position relative to the main support leg 21 by a spring (not shown) loaded button 27 carried by the main support leg that is received in one of the leg section's height adjustment holes 22. This button 27 is normally spring biased outward relative to the main support leg 21. Accordingly, the height H of the rear leg, and therefor the height of the walker's hand grips 18 relative to ground level, can be adjusted simply by causing the spring-loaded button 27 on the main support leg 21 to be received in the desired one of the height adjustment holes 22 in the stationary leg section 20.

Although only the rear legs 15 of the walker shown in FIG. 1 are provided with this height adjustable stationary leg section 20, the front legs 14 of the walker may also be provided with identical height adjustable stationary leg sections if desired by the user. In other words, the main support leg 28 of each front leg 14 is each provided with a spring loaded button 29 that could cooperate with a stationary leg section identical to those stationary leg sections 20 shown for the rear legs 15 if so desired by the walker's user. And it is these stationary leg sections 20 that are replaceable (if desired by the walker's user) with mobile leg sections 30 (the front legs 14 being so shown in FIG. 2) in order to create the wheeled walker shown in FIGS. 1 or 1*a*.

A unique leg support system, for each front leg, includes a height adjustable mobile leg section 30 having a cup shaped rubber foot 31 on one end, that leg section being tubular in cross section and having a series of height adjustment holes 32 on a line 33 parallel to the section's longitudinal axis 34, all the same as that of the rear leg sections 20 previously described. However, the mobile leg section 30 also carries a wheel 35 alongside of, i.e., outboard of the leg section. The wheel 35 is rotationally connected to the leg section 30 through a wheel axle 36 enclosed by sleeve 37, the wheel axle also being positioned outboard or outside of the leg section. The wheel axle 36 is connected to a pivot axle 38 by connector rod 39 with the pivot and wheel axles being disposed generally parallel, thereby providing a generally U-shaped configuration. The pivot axle 38 is pivotally connected to the leg section 30 on a pivot axis 40 normal to the leg section's longitudinal axis 34. The pivot axle 38 is held in pivot relation with the tubular leg section by bushings 41, 42 at opposite ends, the bushing 41 at the pivot axle's free end being in the form of a snap fit cap so the pivot axle does not pull out of bore 43 in the leg section 30. The wheel 35 is held in connected relation with the wheel axle 36 by a snap cap 44 at the outer end of the wheel axle and the sleeve 37 on the wheel axle.

The wheel axle 36 is spring 45 loaded to a first position where the wheel axle 36, 37 abuts the outer surface of the leg section 30 as shown in FIG. 2. The spring 45 loading is provided by a torsion spring that has a friction fit section 46 at one end which fixably connects the torsion spring in coaxial relation with the pivot axle 38 internally of the leg section 30. The spring's torsion spring section 47 surrounds the pivot axle 38, is itself not fixably connected thereto, and is provided with a spring end 48 which abuts the interior surface 49 of the tube section 30. Accordingly, the spring 45 loading for the wheel 35 is entirely carried within the tube section 30. And the torsion spring 45 is mounted on the pivot axle in such fashion that the higher the loading on the torsion spring the tighter the friction fit end section 46 of that spring grips the pivot axle 38. As shown particularly in FIG. 2, the torsion spring 45 causes the wheel axle 36, 37 to abut against the exterior surface of the leg section 30 in response to its normal spring bias when no downward loading or force 50 of any kind is exerted on that tube section 30.

The leg support system 10 of this invention provides the walker with two different use modes. In the first use mode, not illustrated, the walker is provided with four stationary leg sections which are the same as the stationary leg sections 20 shown on the rear legs 15 of FIG. 1. In this stationary or non-rolling mode, the walker's front 14 and rear 15 legs are height adjustable, but the walker must be lifted up when it is desired by the walker's user to move it forward.

When it is desired to provide the walker with wheels 35 on the front legs 14, the stationary leg sections on the front legs are simply replaced with the mobile leg sections 10 shown in FIG. 2. This is easily achieved because of the spring-loaded button 29 and height-hole 32 adjustment interconnect structure previously described. With the stationary leg sections 20 removed from the walker's main front support legs 28, the tubular leg sections 30 of the mobile legs 10 are simply telescoped over those front main support legs so that the spring loaded buttons 29 interfit with the desired height adjustment hole 32.

Note particularly, as shown in FIG. 1, that one 30*a* of the mobile leg sections has the wheel 35 mounted on one side of the height adjustment holes 32, and the other 30*b* of the mobile leg sections has the wheel mounted on the other side of the height adjustment holes, when both leg sections 30*a*, 30*b* are viewed from a line of sight 51 normal to the hole line 33 where the holes 32 are visible, thereby providing two different front leg structures in the sense that the wheel of one is mounted to one side of the height adjustment hole line and the wheel of the other is mounted to the other side of the height adjustment hole line. This permits the mobile leg sections 30 to be connected with the front main support legs 28 in that fashion shown in FIG. 1 where the wheels 35 are inboard of the front legs 14 and adjacent one to the other, or in that fashion shown in FIG. 1*a* where the wheels are outboard of the front legs with the legs adjacent one to the other. On the other hand, the same result could be achieved through use of a single leg section structure (not shown) where two sets of height adjustment holes 32 are provided, those two hole sets being along lines which are parallel to one another, and which are diametrically opposite one another, on the mobile leg section's surface. The important point here is, however, that whether two different structured leg sections 30 are provided as shown in FIGS. 1 and 2, or a single leg section structure is provided as discussed, the user may mount the wheels 35 on either the inside of the walker's front legs 14 as shown in FIG. 1, or on the outside of the walker's front legs as shown in FIG. 1*a*. If the wheels 35 are mounted on the outside, from the positive standpoint somewhat greater stability is provided to the walker but from the negative standpoint a somewhat wider walker is created. On the other hand, if the wheels 35 are mounted on the inside, the walker's width is not increased at all which may be desirable in confined spaces. But in both situations, i.e., in both the FIGS. 1 and 1*a* structure, note that the walker's wheel axles 36 are in front of the walker's front legs 14, relative to the walking direction 53 of the walker, which also tends to increase the stability of the walker. So the replacement leg concept hereindisclosed permits a standard height adjustable walker to be transformed into a height adjustable wheeled walker and vice-versa.

In use, and with the walker in the position illustrated in FIG. 1, a minor operational load is exerted on the wheels 35 because of the weight of the walker frame itself, but this minor operational load relative to ground is such that the torsion springs 45 maintain the wheel axles 36 abutted against the front surfaces of leg sections 30 so that the front legs' feet 31 remain elevated above ground 54 a distance D shown in FIG. 2. In this attitude, the walker's user can easily push the walker forward a desired distance simply by exerting a forward force component shown by phantom arrow 53. This permits the walker's front legs 14 to roll forward, and the walker's rear legs 15 can be either lifted up or simply allowed to slide along the ground as the walker is pushed forward by the user.

When the user, who is holding onto the walker's hand grips 18, desires to step forward, the user's forward step will cause a significant downward force in the form of a major operational load relative to ground as shown by phantom arrow 50 in FIG. 1. This major operational load will overcome the spring bias of the torsion springs 45 so that the walker's front legs 14 move downwardly until those legs' feet 31 contact ground 54. The legs' feet 31 being made of a high friction substance, e.g., rubber cups, thereby prevent the walker from moving forwardly again as the walker's user is stepping forward into the frame in the direction shown by phantom arrow 53 in FIG. 1.

Having described in detail the preferred embodiment of my invention, what I desire to claim and protect by Letters Patent is:

1. A leg support system comprising first and second main support legs, first and second mobile legs, each of said mobile legs being connectable to one of said main support legs, each mobile leg being usable to support a minor operational load relative to ground with said leg's foot being supported above ground so that said leg is mobile relative to ground when in the minor load support mode, and said mobile leg also being usable to support a major operational load relative to ground with said leg's foot resting on ground so that said leg is not mobile relative to ground when in the major load support mode, said mobile legs being separate and independent one from the other when disconnected from said two main support legs, a wheel connected to each of said mobile legs for rendering said mobile legs mobile in the minor operational load support position, each wheel being positioned to one side of its associated support leg relative to the expected motion direction of said support leg when said mobile leg is connected to said main support leg, and a connector device for connecting each pair of main support and mobile legs, said connector device being partially carried by said main support leg and said mobile leg of each pair, said connector devices cooperating with said main support legs to allow said first and second mobile legs to be connected to said first and second main support legs, respectively, and also to allow said first and second mobile legs to be connected to said second and first main support legs, respectively, both said connector devices cooperating to permit said wheels to be positioned adjacent to each other inboard of said main support legs, or separated one from the other by said main support legs outboard of said main support legs, as desired by the user when said mobile legs are connected to said main support legs.

2. A support leg system as set forth in claim 1, comprising a stationary leg connectable to each main support leg to provide said main support leg with a first leg configuration, said main support leg's first configuration being usable to support both minor and major operational loads relative to ground with said leg's foot resting on ground so that said leg is not mobile relative to ground when in either the minor or major load support modes, the stationary leg or mobile leg selected by the system's user being dependent on whether that user desires the main support leg to have a mobile function when in the minor operational load support mode, and said connector device also being partially carried by said stationary leg, those portions of said device carried by said stationary leg and said mobile leg having substantially the same functional structures so that said mobile leg can easily replace said stationary leg in structural combination with said main support leg, and vice versa.

3. A leg support system as set forth in claim 1, said system comprising a height adjustor device for each pair of main support and mobile legs, said height adjustor device permitting a user to adjust the height of said main support leg with either of said stationary leg and said mobile leg connected thereto.

4. A leg support system as set forth in claim 3, said system comprising a tubular post as a component of at least one of said main leg and of said mobile leg, said main support leg being telescopable being relative to said mobile legs in assembly therewith and disassembly therefrom, spring loaded button connected with one of said main support leg and said mobile leg, as a component of said connector and height adjustor devices, and a series of holes formed along the length of the other one of said main support leg and said mobile leg, as a component of said connector and height adjustor devices.

5. A leg support system as set forth in claim 1, said mobile leg comprising a leg section connectable to said main support leg, a wheel rotationally connected to said leg section, and a resilient device normally biasing said mobile leg to a mobile position where the leg section's foot is supported above ground so that main support leg can be rolled along ground on said wheel during support of a minor operational load by said main support leg, but permitting the leg section's foot to move down against that biasing force to a stationary position so that said foot rests on ground in support of a major operational load on said main support leg so that said main support leg cannot be rolled along the ground on said wheel.

6. A leg support system as set forth in claim 5, said mobile leg comprising a wheel axle on which said wheel is carried, said wheel axle being positioned outboard of said mobile leg, and said wheel axle abutting said leg section to locate said mobile leg in the minor operational mode position, and a pivot axle connected to said leg section, said pivot axle being adapted to pivot on an axis perpendicular to the main support leg's longitudinal axis when said mobile leg is connected therewith, said wheel axle being generally parallel to and connected with said pivot axle to form a generally U-shaped double axle element.

7. A leg support system as set forth in claim 6, said leg section comprising a tubular post, said pivot axle extending through said tubular post, and said torsion spring being positioned interiorly of said tubular post.

8. A support leg system having a mobile leg connectable to a main support leg, said mobile leg being usable to support a minor operational load relative to ground with said leg's foot being supported above ground so that said leg is mobile relative to ground when in the minor load support mode, and said mobile leg also being usable to support a major operational load relative to ground with said leg's foot resting on ground so that said leg is not mobile relative to ground when in the major load support mode, said mobile leg comprising a leg section connectable to said main support leg, a wheel rotationally connected to a wheel axle, said wheel axle being positioned outboard of said leg section, and said wheel axle abutting said leg section to locate said mobile leg in the minor operational load support mode, a pivot axle connected to said leg section, said pivot axle being adapted to pivot on an axis generally perpendicular to said leg section's axis, said wheel axle also being connected to said pivot axle, and a resilient device normally biasing said mobile leg to the minor operational load position where said wheel axle abuts said leg section and where said leg section's foot is supported above ground, thereby permitting said leg to be rolled along the ground on said wheel during support of a minor operational load by said main support leg but permitting the leg's foot to move down against that biasing force to a stationary position so that said leg section's foot rests on ground in response to a major operational load on said support leg so that said leg cannot be rolled along the ground on said wheel.

9. A leg support system as set forth in claim 8, said system comprising a tubular post as a component of at least one of said main leg and of said mobile leg, said main support leg being telescopable being relative to said stationary and mobile legs in assembly therewith and disassembly therefrom, a spring loaded button connected with one of said main support leg and of said mobile leg, and a series of holes formed along the length of the other one of said main support leg and of said mobile leg, said components permitting said main support and mobile legs to be connected together at that height location desired by the end user.

10. A leg support system as set forth in claim 9, said wheel axle being parallel to and connected with said pivot axle to form a generally U-shaped double axle element.

11. A leg support system as set forth in claim 10, said resilient device comprising a torsion spring connected with said pivot axle, and said leg section comprising a tubular post, said pivot axle extending through said tubular post, and said torsion spring being positioned interiorly of said tubular post.

* * * * *